United States Patent [19]

Natio et al.

[11] Patent Number: 4,862,174

[45] Date of Patent: Aug. 29, 1989

[54] ELECTROMAGNETIC WAVE ABSORBER

[76] Inventors: Yoshiyuki Natio, 9-29, Tsukimino 8-chome, Yamato; Michiharu Takahashi, 390-190 Takatsu, Yachiyo, both of Japan

[21] Appl. No.: 70,420

[22] Filed: Jul. 7, 1987

[30] Foreign Application Priority Data

Nov. 19, 1986 [JP] Japan ..... 61-276288

[51] Int. Cl.[4] ..... H01Q 17/00

[52] U.S. Cl. ..... 342/1

[58] Field of Search ..... 342/1–4

[56] References Cited

U.S. PATENT DOCUMENTS

| | | | |
|---|---|---|---|
| 3,308,462 | 3/1967 | Gluck | 342/1 |
| 3,540,047 | 11/1970 | Walser et al. | 342/1 |
| 3,737,903 | 6/1973 | Suetake et al. | 342/1 |
| 3,754,255 | 8/1973 | Suetake et al. | 342/4 |
| 3,938,152 | 2/1976 | Grimes et al. | 342/1 |
| 4,003,840 | 1/1977 | Ishino et al. | 342/1 X |
| 4,012,738 | 3/1977 | Wright | 342/1 |
| 4,023,174 | 5/1977 | Wright | 342/4 |
| 4,602,141 | 7/1986 | Natio et al. | 342/1 X |

*Primary Examiner*—Theodore M. Blum
*Assistant Examiner*—Bernarr Earl Gregory

[57] ABSTRACT

An electromagnetic wave absorber containing a mixture of a magnetic material and a carbon material, both in powder form, in a binding medium so as to suspend both kinds of powder particles in space wherein the weight proportions of said binding medium taken as unity, said magnetic material in powder form, and said carbon material in powder form 1:F:C fall within the following limitation ranges:

$$|F-C| \leqq 0.3.$$

$$0.45 \leqq F \leqq 1.05.$$

$$0.45 \leqq C \leqq 1.05.$$

3 Claims, 2 Drawing Sheets

ELECTROMAGNETIC WAVE ABSORBER

BACKGROUND OF THE INVENTION

1. Technical Field

The present invention relates to an electromagnetic wave absorber, i.e., a material that takes up and dissipates electromagnetic energy radiated from an object.

2. Prior Art

Numerous kinds of electromagnetic wave absorbers for preventing reflection of electromagnetic energy from an object have been developed.

However, these conventional materials have been found by no means satisfactory to meet the need for reduction in the weight and thickness, especially when they are attached as external walls onto buildings or aircraft.

SUMMARY OF THE INVENTION

Accordingly it is an object of the present invention to provide improved electromagnetic wave absorbers that can be made sufficiently thin and light weight and yet, having satisfactory electromagnetic wave absorbing properties.

In order to achieve the above-mentioned objectives, it is the intent of the present invention to provide an electromagnetic wave absorber containing both carbon and ferrite in approximately equal amounts.

Such absorbers as produced by the principle of this invention have proven to demonstrate the electromagnetic energy absorbing properties equivalent to or better than any other similar conventional absorbers in spite of reduction in the thickness.

Another advantage of these materials is the capability for further reduction in the overall weight because of sufficient carbon content in the mixed constituents.

Still another advantage of these materials is the capability for achieving the required electromagnetic wave absorbing properties despite the variation in the mixed ratio of the constituents or in the thickness of the materials.

A further advantage of these materials is that they are inexpensive, because carbon itself is quite cheap.

BRIEF DESCRIPTION OF THE DRAWINGS

In order that these substantial advantages of the new compositions of the electromagnetic wave absorbers according to this invention may be fully appreciated, reference will be made to the attached drawings, wherein.

DETAILED DESCRIPTION OF THE INVENTION

Related Prior Art

Figure 1:
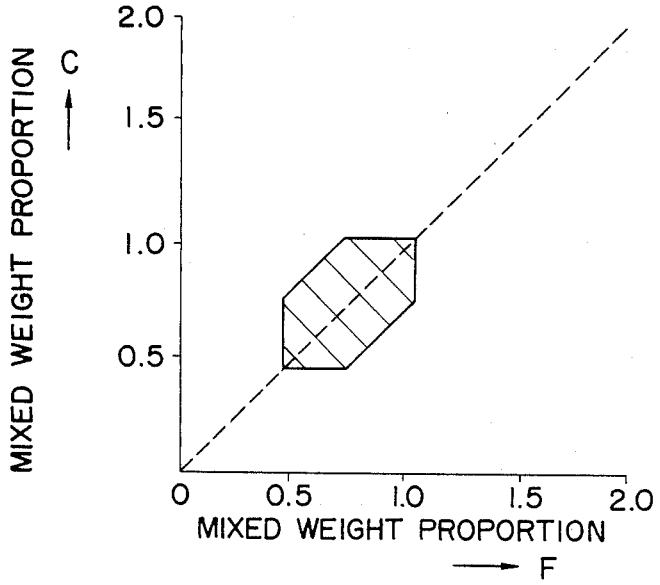
FIG. 1 illustrates a characteristic diagram to show the proper mixing ratios of the two materials contained in the electromagnetic wave absorbers according to this invention.

The conventionally proposed electromagnetic wave absorbers of these kinds may be said to have adopted either of the three loss constants as follows:

(i) Conduction loss $\sigma$ (ii) Magnetic loss $\mu r''$ (iii) Dielectric loss $\epsilon r''$ Typical materials representing these losses are the following:

(a) Carbon, carbon powder (b) Ferrite, ferrite powder (c) High dielectric constant material, or the same in powder form There are two alternative cases where these materials are practically applied: One is to use these materials themselves as electromagnetic wave absorbers and the other is to use these materials as mixed with some suitable binding medium, such as resins, rubbers, or paints so as to comprise them.

It will be understood that in view of the manufacturing costs the present invention is solely concerned with the latter cases and that materials belonging to (c) are left out of consideration, because we were fully cognizant of the fact that they are inferior in the characteristics to those belonging to (a).

Typical examples of materials using the conduction loss are (a) carbon, etc., while those using the magnetic loss are (b) ferrite, etc.

Now let it be required to consider an electromagnetic wave absorber whose weight proportions of the carbon and ferrite constituents relative to the weight of the binding medium taken as unity are donated by C and F, respectively.

The conventional approaches to the development of such electromagnetic wave absorbers were directed to materials either belonging to (b)—that is, $C=0$ and $F\neq 0$ or belonging to (a)—that is, $F=0$ and $C\neq 0$ relative to the weight of the binding medium taken as unity. For instance, conventional electromagnetic wave absorbers that have been developed for 9.4 GHz band (X-band) application are as detailed below.

Absorbers corresponding to $F=0$ and $C\neq 0$—that is, those using the conduction loss (i) exhibit the performance data as shown in Table 1.

The 20 DB-down bandwidth (power reflection factor to be less than 1 percent) increases with increasing thickness, but it is a little narrower than anticipated.

TABLE 1

| Thickness d (mm) | Bandwidth (MHz) | Fractional Bandwidth (%) |
|---|---|---|
| 1 | 100 | 1.06 |
| 1.5 | 220 | 2.34 |
| 2.5 | 325 | 3.47 |

Conventional absorbers using the magnetic loss (ii), which correspond to $F\neq 0$ and $C=0$ will now be discussed. Extensive experimentation has verified that irrespective of the kind of ferrite powder used, the performance data obtained from these materials with the thicknesses of the order of 2.5 to 3.0 mm remain as follows: The 20 dB-down bandwidth covers 300 to 500 MHz and the fractional bandwidth covers 3.2 to 5.3 percent.

In recent years, research has been made on the feasibility of improvements in the electrical performance of electromagnetic wave absorbers comprising a mixture of a ferrite as the main constituent and small amounts of carbon, or of carbon as the main constituent and small amounts of a ferrite.

It has been experimentally verified that in the former case the thickness can be reduced by about 30 percent with the bandwidth remaining unchanged, while in the latter case, the bandwidth becomes wider as much as twice with the thickness remaining unchanged.

In spite of these advantages, any one of these conventional absorbers has been found still unsatisfactory for some practical applications in view of its heavy weight, for instance, when used as external walls of buildings or aircraft.

PREFERRED EMBODIMENTS

In order to solve the above-mentioned problems, any electromagnetic absorber produced according to the principle of this invention contains both carbon and ferrite in approximately equal amounts.

FIG. 1 illustrates the domain (hatched) in which the mixing ratios of these materials for new electromagnetic wave absorbers according to this invention can exist.

Figure 3:
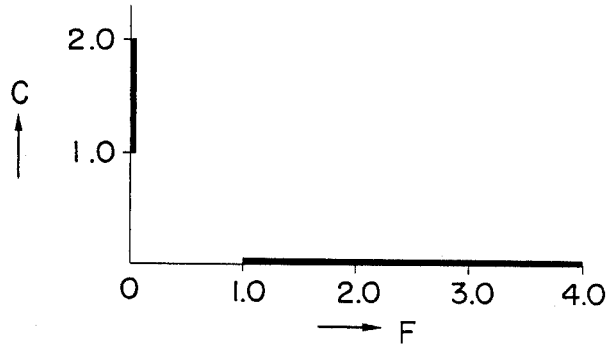
FIG. 3 PRIOR ART
FIG. 3 and FIG. 4 each illustrate the compositions of conventional electromagnetic wave absorbers.
Figure 4:
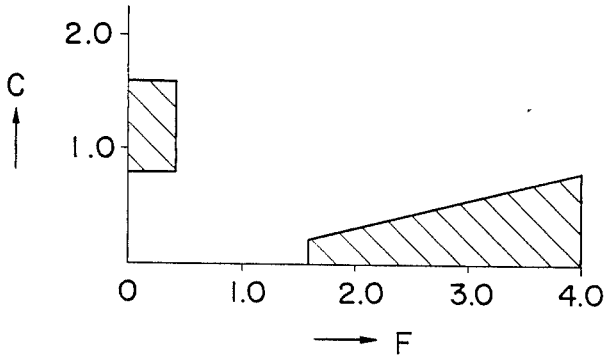
FIG. 4 PRIOR ART

A comparison of FIG. 1 with FIGS. 3 and 4 will readily reveal that the essence of the present invention resides in the use of approximately equal weights of carbon and ferrite materials. Stated more specifically, the present invention is established only in the hatched hexagonal domain in FIG. 1 whose axis (dashes) is aligned with the line bisecting the right angle formed by the F and C coordinate axes. In contrast, developmental efforts for the conventional electromagnetic wave absorbers were directed to the compositions plotted on or in the vicinity of the F and C coordinate axes as shown in FIG. 3.

Materials used are a MnZn ferrite whose specific permeability is 2,700 in powder form and graphite as carbon.

The proportions of these materials, F and C, for several embodiments of this invention, (A) through (D), are listed as follows:

(A) $0.45 \leqq F \leqq 0.75$, $0.45 \leqq C \leqq 0.75$.

(B) $0.55 \leqq F \leqq 0.85$, $0.55 \leqq C \leqq 0.85$.

(C) $0.65 \leqq F \leqq 0.95$, $0.65 \leqq C \leqq 0.95$.

(D) $0.75 \leqq F \leqq 1.05$, $0.75 \leqq C \leqq 1.05$.

Table 2 that follows gives performance data for these embodiments of our invention.

TABLE 2

| | Thickness d (mm) | Center Frequency (MHz) | Bandwidth (MHz) |
|---|---|---|---|
| A | 3.2 | 4,500 | 450 |
| B | 2.5 | 6,000 | 900 |
| C | 1.5 | 9,400 | 870 |
| D | 1.1 | 11,000 | 880 |

Note that these performance data represent the best of all characteristics of electromagnetic wave absorbers which have been so far investigated.

In particular, whereas the thicknesses of the order of 2.5 mm were required for the conventional absorbers for X-band application, the excellent characteristics—rather wider bandwidths in spite of thinner thicknesses of the order of 1.5 mm—can be obtained by this invention.

Figure 2:
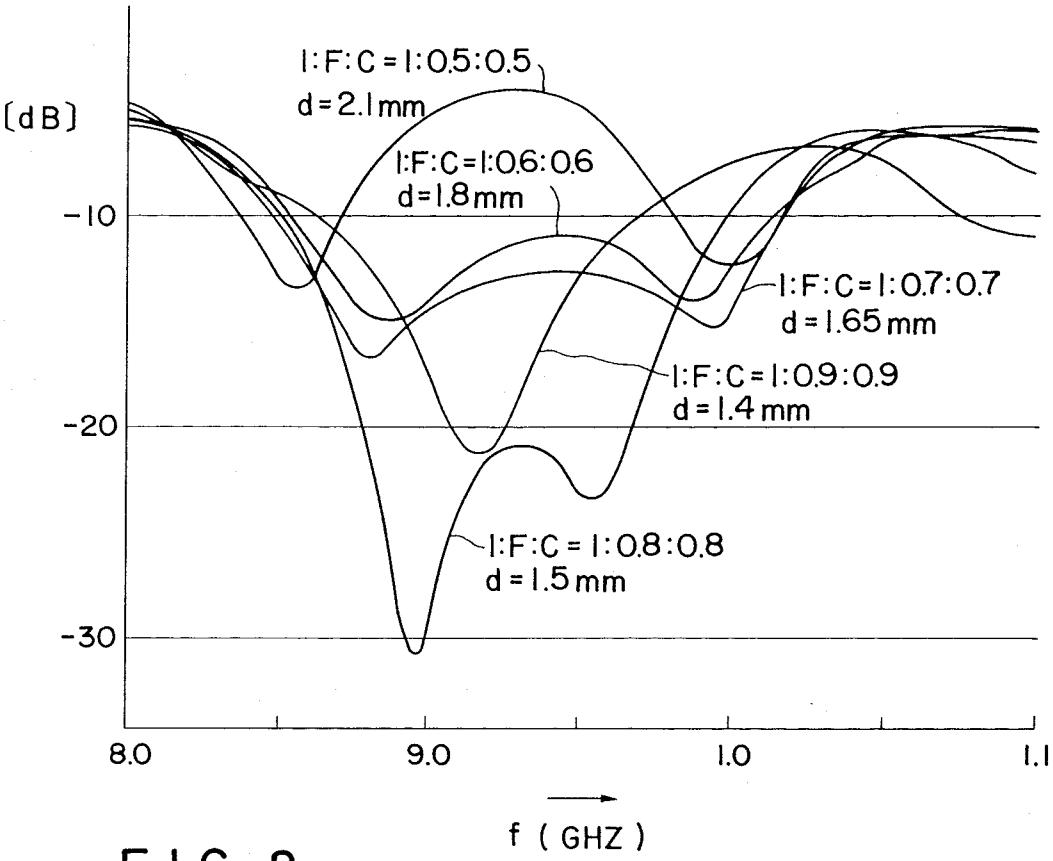
FIG. 2 illustrates the frequency vs reflection loss characteristics for several embodiments of the present invention.

FIG. 2 shows the frequency vs reflection loss characteristics for several embodiments of this invention. Inspection of this figure reveals at once that an electromagnetic wave absorber whose reflection loss can be taken more than 20 dB from 8.75 to 9.62 GHz—i.e., over the 870 MHz bandwidth, is available with $d=1.5$ mm for $C=F=0.8$.

Obviously, this represents a marked improvement in the thickness and in the bandwidth over the conventional absorbers whose bandwidths range from 300 to 500 MHz with the thicknesses of the order of from 2.5 to 3.0 mm.

What is claimed is:

1. An electromagnetic wave absorber containing a mixture of a magnetic material and a carbon material, both in powder form, in a binding medium wherein the weight proportions of said binding medium taken as unity, said magnetic material in powder form, and said carbon material in powder form 1:F:C fall within the following limitation ranges:

$$|F-C| \leqq 0.3,$$

$$0.45 \leqq F \leqq 1.05,$$

$$0.45 \leqq C \leqq 1.05,$$

where F represent the magnetic materials and C represents the carbon material.

2. An electromagnetic wave absorber according to claim 1 wherein said magnetic material in powder form consists of a MnZn ferrite whose specific magnetic permeability is 2,700.

3. An electromagnetic wave absorber according to claim 1 wherein said carbon material in powder form consists of graphite.

* * * * *

UNITED STATES PATENT AND TRADEMARK OFFICE

CERTIFICATE OF CORRECTION

PATENT NO. : 4,862,174

DATED : August 29, 1989

INVENTOR(S) : NAITO et al.

It is certified that error appears in the above-identified patent and that said Letters Patent is hereby corrected as shown below:

On the title page

Correct the names of the applicants from "NATIO et al." to -- NAITO et al. --.

Signed and Sealed this

Sixteenth Day of October, 1990

*Attest:*

HARRY F. MANBECK, JR.

*Attesting Officer*

*Commissioner of Patents and Trademarks*